US007136789B2

(12) United States Patent
Mosier et al.

(10) Patent No.: US 7,136,789 B2
(45) Date of Patent: Nov. 14, 2006

(54) METHOD FOR PRODUCING A CONSTRAINT-SATISFIED CAM ACCELERATION PROFILE

(75) Inventors: Ronald G. Mosier, Royal Oak, MI (US); Bruce Geist, Sterling Heights, MI (US); William F Resh, E. Lansing, MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 682 days.

(21) Appl. No.: 10/649,442

(22) Filed: Aug. 26, 2003

(65) Prior Publication Data

US 2005/0049776 A1 Mar. 3, 2005

(51) Int. Cl.
*G06F 17/10* (2006.01)
*G06F 17/50* (2006.01)

(52) U.S. Cl. ..... 703/2; 703/1; 703/6; 703/7; 703/8; 701/101; 123/90.16; 123/188.3

(58) Field of Classification Search ..... 703/1, 703/2, 6–8; 701/101; 123/188.3, 90.12
See application file for complete search history.

(56) References Cited

U.S. PATENT DOCUMENTS 6,053,134 A * 4/2000 Linebarger ..... 123/90.16
6,257,190 B1 * 7/2001 Linebarger ..... 123/188.3
7,077,083 B1 * 7/2006 Dingle et al. ..... 123/90.12

OTHER PUBLICATIONS

"ADAMS/Engine powered by FEV", MSC.ADAMS Product Specification MSC 2003.*
"Numerical-Experimental Analysis of the Timing System of an Internal Combustion Engine", Cali et al, University of Rome, Oct. 2001.*
"Design and Development of a Mechanical Variable Valve Actuation System", Pierik et al, Variable Valve Actuation 2000, SAE 2000-01-1221, SAE Mar. 2000.*
"ADAMS User Conference Japan 2001", Mechanical Dynamics, 2001.*
"Cam shape optimization by genetic alogrithm", Lampinen, Computer Aided Design 35, pp. 727-737, Dec. 2002.*
"Simulation helps improve valve trains", Machine Design, Automotive Special Addition, pp. S6, Feb. 2003.*

* cited by examiner

*Primary Examiner*—Fred Ferris
(74) *Attorney, Agent, or Firm*—Ralph E. Smith

(57) ABSTRACT

A method for generating an acceleration profile for a valve operating cam of an internal combustion engine varies an adjustment point of an initial draft acceleration profile curve such that a determinant of a set of equations defining valve motion constraints and scaling factors is forced to zero. The equations may then be solved for values of the scaling factors which are applied to the initial draft acceleration profile curve to generate a desired profile which satisfies valve motion constraints.

20 Claims, 6 Drawing Sheets

METHOD FOR PRODUCING A CONSTRAINT-SATISFIED CAM ACCELERATION PROFILE

BACKGROUND OF THE INVENTION

1. Field of the Invention

The invention relates generally to methods for designing the profile of a cam for actuating a valve mechanism. More specifically, the invention relates to generation of an acceleration profile for a valve operating cam of an internal combustion engine, the profile satisfying a plurality of valve motion constraints.

2. Discussion of the Prior Art

Internal combustion engines use a well-known cam shaft system with a plurality of cams for opening and closing various valves associated with individual combustion cylinders of the engine. A conventional cam-actuated engine valve arrangement is shown in FIG. 1. Cam 101 rotates in the direction shown by arrow 113 so as to move cam follower or tappet 103 and push rod 105 against rocker arm 107 which, in turn, causes motion of spring biased valve 111 in an opening or closing direction for controlling communication with cylinder volume 115 with an input or output conduit 113. Valve 111 is biased to a closed or sealed position with respect to conduit 113 by biasing valve spring 109. Zero degree cam angle rotation is defined as when cam nose 101*a* is in a vertically upward direction as shown in FIG. 1 wherein valve 11 would be in a fully open position.

At the very beginning of the cam design process, a cam designer may be presented with design parameters, such as overlap volume, intake valve closing volume, exhaust pseudo flow velocity and blow down volume. Additionally, manufacturing constraints such as the smallest radius of curvature that can be ground with a specific grinding wheel play a roll in the design process.

Computerized techniques allow designers to specify how the valve is to move by specifying the valve acceleration. These computerized techniques then determine the shape the cam needs to take in order to deliver the desired valve acceleration profile as the cam makes a total rotation.

Unless a design engineer is extremely lucky, the initially selected acceleration profile for the cam will not meet all of a plurality of valve motion constraints without adjusting the initial profile. Prior techniques for transforming draft acceleration curves into an acceleration profile that meets all valve motion constraints are known, wherein a plurality of scaling constants are sought to scale the various acceleration pulses formed by the acceleration curve such that the valve motion constraints will be satisfied. In known systems, there are four valve motion constraints but only three scaling constants due to the nature of the acceleration profile curve. Hence, a fourth design variable is chosen to be an adjustment design point acceleration value of the design engineer's choosing.

The constraint satisfaction problem has conventionally been solved as a non-linear four-dimensional root-finding problem. The adjustment acceleration value and the three scaling constants have in the past been adjusted by generic root-finding software in an effort to determine values of these four design parameters that yield an adjusted trial curve that meets all constraints to within an acceptable error tolerance. There are problems with this known approach. First, sometimes the known approach does not succeed or it does not deliver a highly precise solution. Secondly, this known optimization approach is more computationally expensive than can be tolerated during interactive design within many popular computing environments (e. g., Matlab/Simulink). Hence, a faster approach is needed.

SUMMARY OF THE INVENTION

In one aspect of the invention, a method for generating an acceleration profile for a valve operating cam of an internal combustion engine, wherein the profile must satisfy a plurality of valve motion constraints, begins with generating a valve acceleration versus cam angle draft curve by specifying a plurality of points of desired valve acceleration versus cam angle and using a curve fitting routine to form the draft acceleration curve interconnecting the plurality of points. A set of equations is developed, one for each of the plurality of constraints in terms of parameters of the draft acceleration curve and in terms of a plurality of scaling factors, one for each section of the draft curve between roots thereof. A determinant for the set of equations is formed. A point on the draft curve is selected as an adjustment point, and the adjustment point is varied to an adjustment acceleration value that forces the determinant to substantially zero. The curve fitting routine is then used again to generate an adjusted acceleration curve which includes the adjustment acceleration value. The set of equations is solved for values of the scaling factors as a function of parameters of the adjusted acceleration curve, and sections of the draft acceleration curve between roots thereof are multiplied by the resultant values of corresponding scaling factors to generate a constraint-satisfied acceleration profile.

BRIEF DESCRIPTION OF THE DRAWING

The objects and features of the invention will become apparent from a reading of a detailed description, taken in conjunction with the drawing, in which.

DETAILED DESCRIPTION

Suppose $I(\theta)$ defines valve lift as a function of the rotation angle $\theta$ of the cam producing that lift. The second derivative of I with respect to $\theta$ is commonly referred to as the valve acceleration profile $a(\theta)$.

Figure 1:
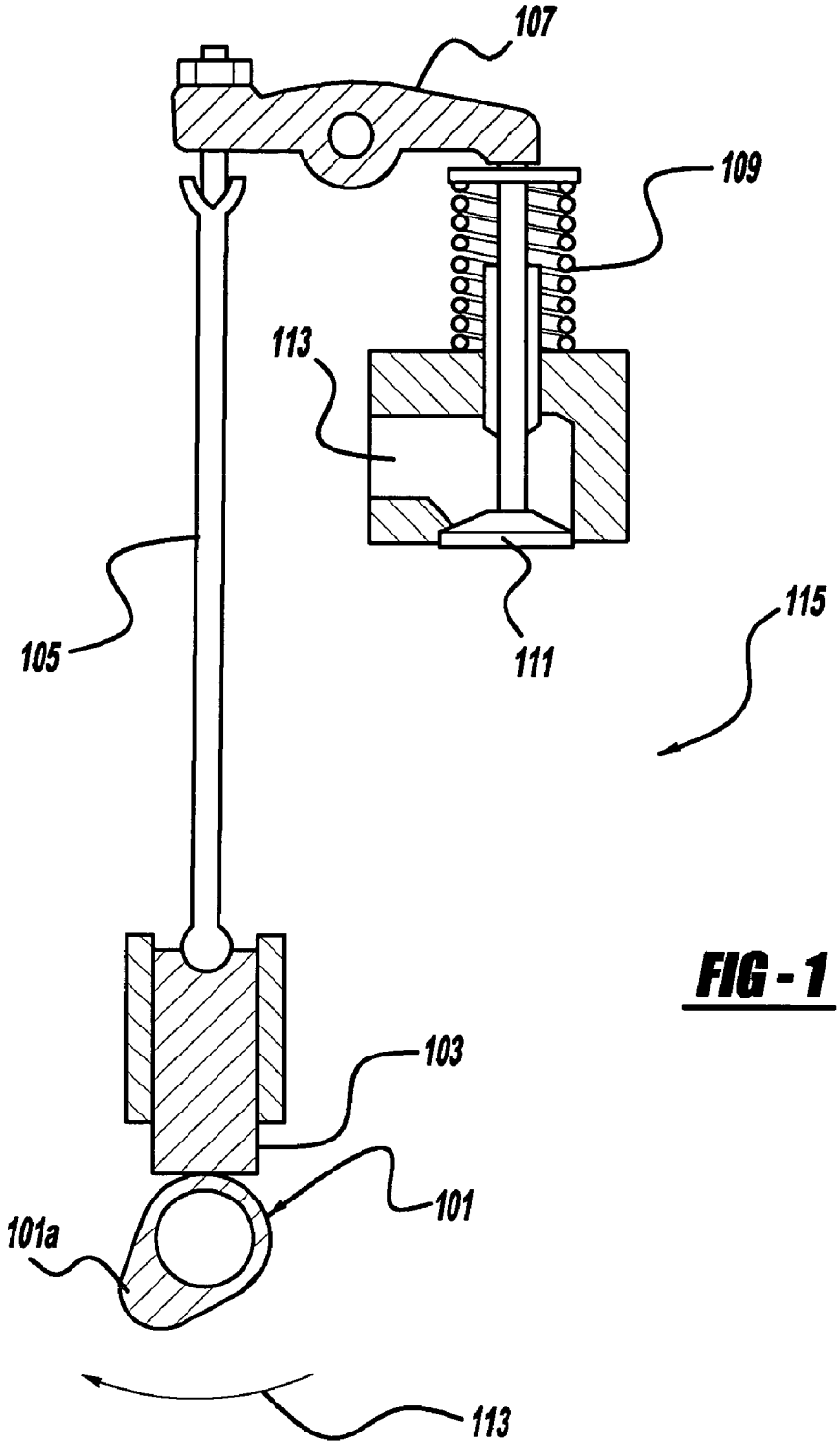
FIG. 1 is a perspective view of a conventional cam-operated valve opening and closing mechanism for an internal combustion engine.
Figure 2:
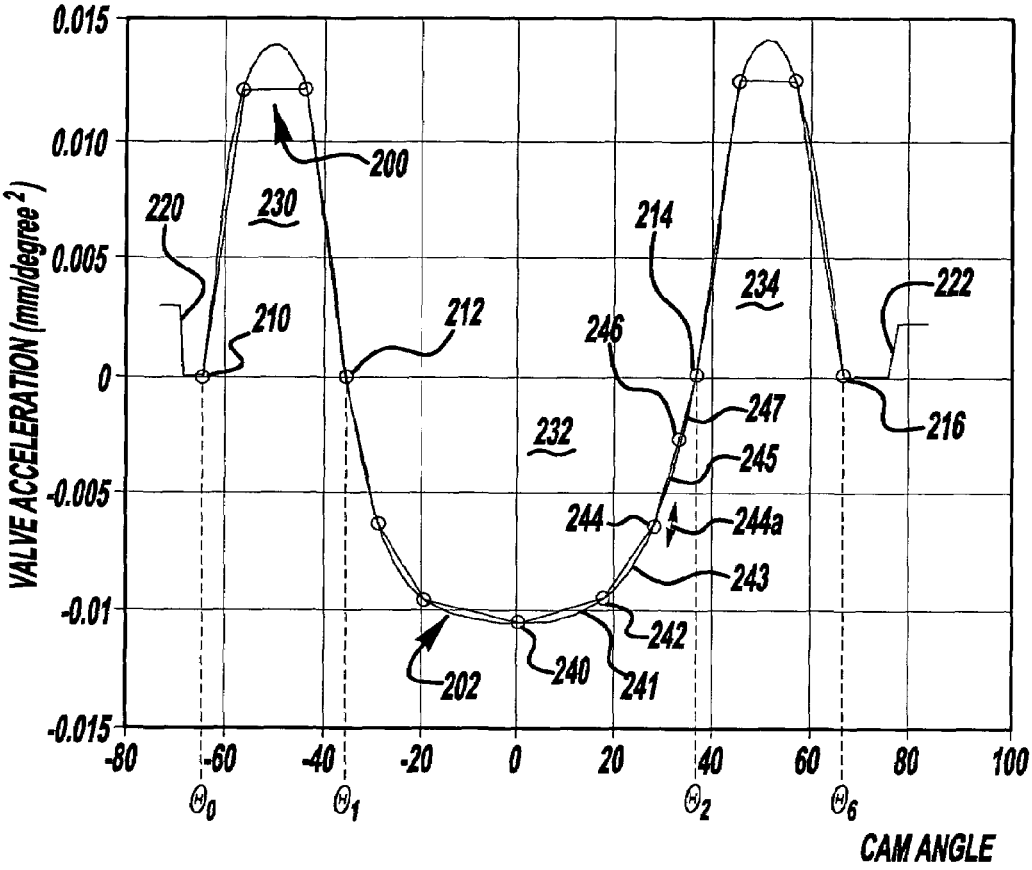
FIG. 2 is a graph of a cam acceleration profile showing an initial draft set of points and a continuous curve fitted among the points.

FIG. 2 shows an example valve acceleration profile for a cam, such as cam 101 of FIG. 1. The horizontal axis indicates cam angle. Cam angle zero corresponds to maximum lift—i.e., the angle where the nose of a cam lobe 101*a* contacts the follower 103. Negative angles correspond to valve motion induced by the opening side of the cam lobe and positive angles indicate motion induced by the closing side of that lobe.

The square waves 220 and 222 on the left and on the right of FIG. 2 are respectively called the opening and closing ramps of the acceleration profile. Acceleration is zero from angle −180° to the beginning of the opening ramp, and from the end of the closing ramp to +180° . Between the two ramps lies a typical valve acceleration curve, often called an acceleration profile, that is composed of three large acceleration pulses. These are the positive opening pulse 230, the negative valve spring pulse 232, and the positive closing pulse 234. Observe that the acceleration over the two positive pulses is always positive except at their boundaries, where the acceleration is zero. Similarly, the acceleration throughout the negative pulse is always negative except at its boundaries, where it is zero. For purposes of discussion throughout this description, it is assumed that draft acceleration curves between the square-wave ramps always consist of a positive pulse, followed immediately by a negative pulse, finally ending with a second positive pulse. There are no zero acceleration values except those occurring at the boundaries of the three pulses.

In typical cam design processes, only the three pulses 230, 232 and 234 between the two opening and closing ramps 220 and 222 are adjusted to create a desirable valve motion. Ramps, and their positioning within the acceleration profile, once set, are not typically varied. A design engineer will add, delete and move points that sketch out a desired acceleration curve or profile. A curve fitting routine, or spline, generates a curve passing through these points of the designer's choosing to define the cam acceleration profile a(θ) between ramps.

The designer's initial rough sketch 200 connects the acceleration data points shown as small circles in FIG. 2 such as 240, 242, 244, 246, 214, etc. The draft acceleration profile 202 is generated by an initial application to the data points of a preselected spline algorithm. The data points are known as "knots".

There are four valve motion constraints that the acceleration profile must meet.

The valve velocity implied by the opening ramp 220 and main acceleration profile must match up to the end velocity $v_c$ implied by the closing ramp 222—i.e., $v(\theta_c)=v_c$.

Similarly, the valve lift implied by the opening ramp 220 and main acceleration profile must match up with the valve lift $I_c$ implied by the closing ramp 222—i.e., $I(\theta_c)=I_c$.

Additionally, the valve lift must achieve a certain maximum value at the nose of the cam or cam angle zero. This imposes two additional constraints. First, the valve lift must be some pre-selected value at cam angle zero ($I(0)=I_{max}$). Secondly, the valve velocity must be zero at cam angle zero ($v(0)=0$).

Figure 3:
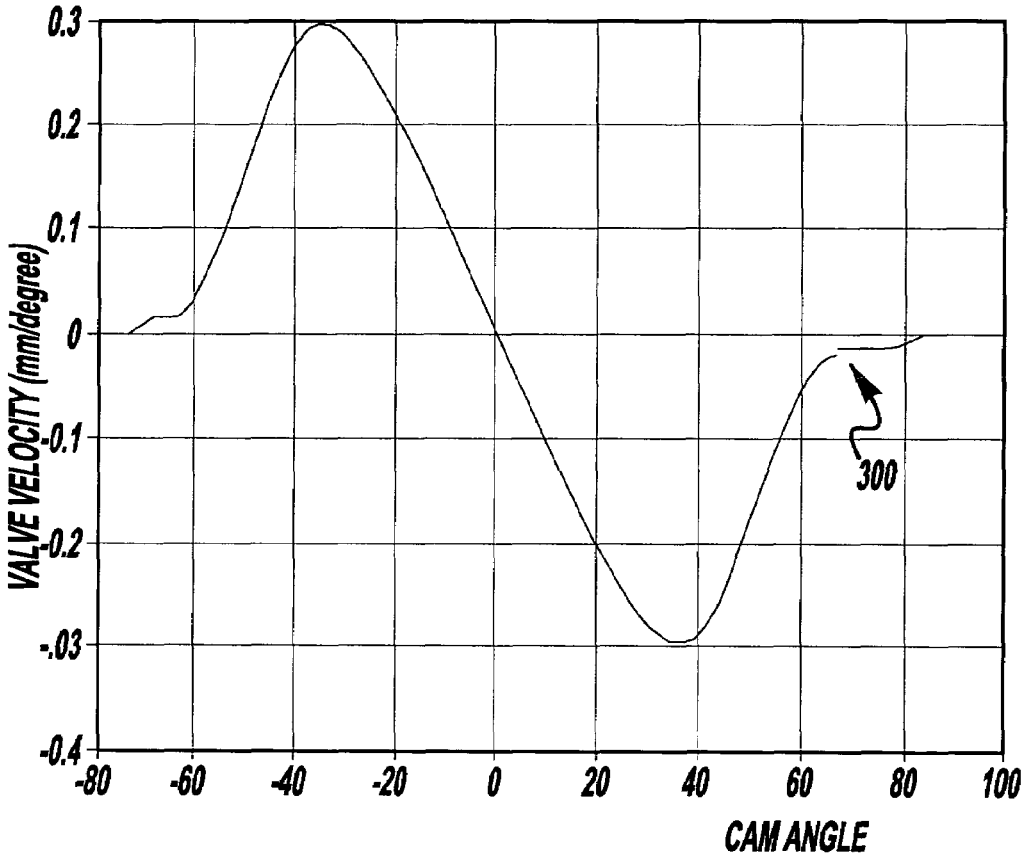
FIG. 3 is a graph of valve velocity versus cam angle resulting from the initial draft acceleration curve of FIG. 2 prior to adjustment of the profile to meet valve motion constraints.

As noted previously, the designer must be extremely fortunate to meet these constraints without adjustment of the initial draft of an acceleration profile. FIG. 3 is a graph of valve velocity versus cam angle where the constraints have not been met. Note at area 300 of the curve of FIG. 3, that the graph shows an end velocity of the cam which does not match up with the velocity generated by the closing ramp of FIG. 2.

Figure 4:
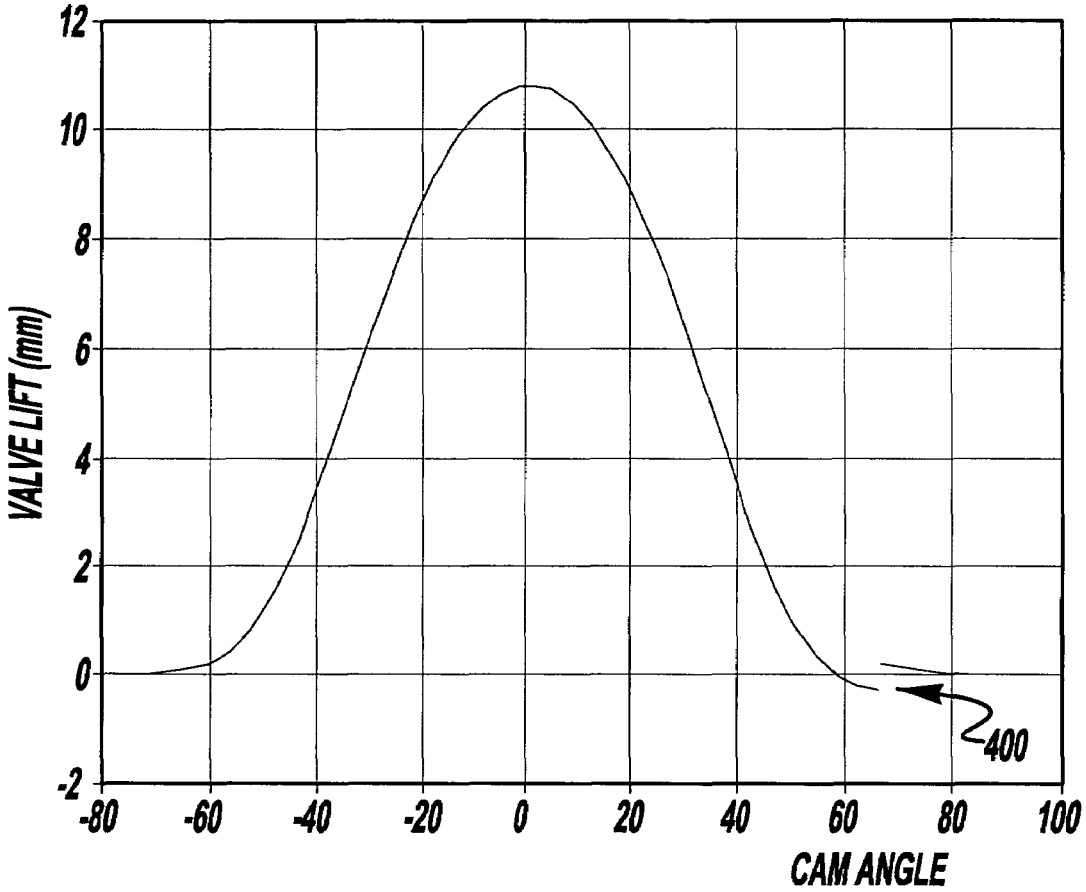
FIG. 4 is a graph of valve lift versus cam angle resulting from the initial draft acceleration curve of FIG. 2 prior to adjustment to meet valve motion constraints.

Similarly, FIG. 4 is a graph of valve lift versus cam angle resulting from an initial draft acceleration curve prior to adjustment which does not meet the valve motion constraints. Area 400 of the graph of FIG. 4 demonstrates that the valve lift generated by the draft acceleration curve of FIG. 2 does not match up with the valve lift generated by the closing ramp of FIG. 2.

With the acceleration profile as generally depicted in FIG. 2, the four constraints set forth above may be expressed in terms of parameters of the initial draft acceleration profile. With reference to FIG. 2, let $\hat{a}(\theta)$ be a draft continuous valve acceleration curve defined on the interval $[\theta_o, \theta_c]$. Let $\theta_o$, $\theta_1$, $\theta_2$ and $\theta_c$ be the only roots of $\hat{a}$ in the interval $\theta_o$ to $\theta_c$ as shown in FIG. 2. We now define a new adjusted continuous acceleration function in terms of $\hat{a}$ as $$a(\theta) = \begin{cases} c_1 \cdot \hat{a}(\theta) & \theta_0 \le \theta < \theta_1, \\ c_2 \cdot \hat{a}(\theta) & \theta_1 \le \theta < \theta_2, \\ c_3 \cdot \hat{a}(\theta) & \theta_2 \le \theta < \theta_3, \end{cases}$$

$c_1$, $c_2$ and $c_3$ are three scaling constants to be respectively applied to acceleration pulses 230, 232 and 234 of FIG. 2.

If a valve undergoes acceleration a(θ) and has velocity $v_o$ and lift $I_o$ when $\theta=\theta_o$, then the lift $I_c$ when $\theta=\theta_c$ for that valve can be shown to be $$l_c = [\theta_c - \theta_0]v_0 + l_0 + c_1 \cdot L_1 + c_2 \cdot L_2 + c_3 \cdot L_3, \tag{1}$$

where $$L_1 = \int_{\theta_0}^{\theta_1} \int_{\theta_0}^{\theta} \hat{a}(s)dsd\theta + [\theta_c - \theta_1] \int_{\theta_0}^{\theta_1} \hat{a}(s)ds,$$

$$L_2 = \int_{\theta_1}^{\theta_2} \int_{\theta_1}^{\theta} \hat{a}(s)dsd\theta + [\theta_c - \theta_2] \int_{\theta_1}^{\theta_2} \hat{a}(s)ds,$$

and $$L_3 = \int_{\theta_2}^{\theta_c} \int_{\theta_2}^{\theta} \hat{a}(s)dsd\theta.$$

Similarly, if a valve undergoes acceleration a(θ) and has a velocity $v_o$ when $\theta=\theta_o$, then the velocity $v_c$ when $\theta=\theta_c$ for that valve is $$v_c = c_1 V_1 + c_2 V_2 + c_3 V_3 + v_0, \tag{2}$$

where $$V_1 = \int_{\theta_0}^{\theta_1} \hat{a}(s)\,ds,$$

$$V_2 = \int_{\theta_1}^{\theta_2} \hat{a}(s)\,ds,$$

and $$V_3 = \int_{\theta_2}^{\theta_c} \hat{a}(s)\,ds.$$

If a valve undergoes acceleration a(θ) and, when $\theta=\theta_o$, that valve has a velocity $v_o$ and lift $I_o$, then at θ=0°, that valve will have lift $$l(0) = -v_0\theta_0 + l_0 + c_1 \cdot L_4 + c_2 \cdot L_5, \tag{3}$$

where

-continued $$L_4 = \int_{\theta_0}^{\theta_1}\int_{\theta_0}^{\theta}\hat{a}(s)ds\,d\theta - \theta_1\int_{\theta_0}^{\theta_1}\hat{a}(s)ds$$

and $$L_5 = \int_{\theta_1}^{0}\int_{\theta_1}^{\theta}\hat{a}(s)ds\,d\theta.$$

Finally, if a valve undergoes acceleration $a(\theta)$ and, when $\theta=\theta_o$, that valve has velocity $v_o$, then when $\theta=0$ the valve velocity is $$v(0) = v_0 + c_1 \cdot V_1 + c_2 \cdot V_4 \tag{4}$$

where $$V_1 = \int_{\theta_0}^{\theta_1}\hat{a}(s)ds,$$

and $$V_4 = \int_{\theta_1}^{0}\hat{a}(s)ds.$$

It can be shown that the above four constraints can be satisfied if and only if the vector $\hat{c}=(c_1, c_2, c_3)^T$ satisfies the matrix equation $$\begin{pmatrix} L_1 & L_2 & L_3 \\ V_1 & V_2 & V_3 \\ L_4 & L_5 & 0 \\ V_1 & V_4 & 0 \end{pmatrix}\begin{pmatrix} c_1 \\ c_2 \\ c_3 \end{pmatrix} = \begin{pmatrix} -[\theta_c-\theta_0]v_0 - l_0 + l_c \\ v_c - v_0 \\ \theta_0 v_0 - l_0 + l_{\max} \\ -v_0 \end{pmatrix}, \tag{5}$$

Furthermore, it can be shown that a unique non-zero solution $\hat{c}$ to equation (5) exists if and only if $$\text{determinant}\begin{pmatrix} L_1 & L_2 & L_3 & -[\theta_c-\theta_0]v_0 - l_0 + l_c \\ V_1 & V_2 & V_3 & v_c - v_0 \\ L_4 & L_5 & 0 & \theta_0 v_0 - l_0 + l_{\max} \\ V_1 & V_4 & 0 & -v_0 \end{pmatrix} = 0. \tag{6}$$

Uniqueness follows from the fact that the determinant of the lower left 3×3 submatrix from the matrix in equation (6) above is never zero, so that the rank of the matrix is always 3 or larger.

Suppose one selects an adjustment point or knot $(\theta_k, z_k) \in S$, where $\theta_o<\theta_k<\theta_c$ and $z_k\neq 0$ (see point 244 of FIG. 2). Define the function $D(z_k)$ as $$D(z_k) \equiv \text{determinant}\begin{pmatrix} L_1(z_k) & L_2(z_k) & L_3(z_k) & -[\theta_c-\theta_0]v_0 - l_0 + l_c \\ V_1(z_k) & V_2(z_k) & V_3(z_k) & v_c - v_0 \\ L_4(z_k) & L_1(z_k) & 0 & \theta_0 v_0 - l_0 + l_{\max} \\ V_1(z_k) & V_4(z_k) & 0 & -v_0 \end{pmatrix}$$

Note that the determinant depends on $\hat{a}$, which in turn is uniquely defined by the points in S that $\hat{a}$ interpolates. Thus, D can be thought of as a function of the non-zero interpolation value $z_k$. For a new value of $z_k$, $D(z_k)$ is calculated by first finding the spline $\hat{a}$ that interpolates the set $\hat{S}$, where $\hat{S}$ is the set S with the point $(\theta_k,z_k)$ replaced by $(\theta_k,\hat{z}_k)$. Then entries $L_1, \ldots, L_5$ and $V_1, \ldots, V_4$ are determined from adjusted $\hat{a}$.

The question becomes: near $z_k$ is there a value $\hat{z}_k$ for which $D(\hat{z}_k)=0$? If so, then the trial acceleration curve that interpolates the point set S could be replaced by the trial acceleration curve that interpolates $\hat{S}$. The resulting trial acceleration curve would look very similar to the curve that interpolates S (since $z_k$ is "near" $\hat{z}_k$). It may therefore be an acceptable replacement for the original $\hat{a}$. The new $\hat{a}$ will be a curve for which a scaling exists to solve the constraint equations developed above.

It should be noted that the basic goal in moving knot $z_k$ is local modification of the valve acceleration profile so that the determinant of equation (6) becomes zero. This goal may be accomplished equally well by moving two or more knots of the spline in concert within a localized region of the curve. However specifically implemented, the basic goal remains the same: add or subtract area from the acceleration profile locally to produce a curve for which equation (6) is satisfied.

Hence, to produce a constraint satisfying acceleration profile or curve a from the draft curve $\hat{a}$ that meets the constraints specified above, one performs the following steps.

Select a point $(\theta_k, z_k)$ in the set S such that $z_k$ is not equal to zero.

For the function $D(z_k)$ defined above, find a non-zero value $\hat{z}_k$ that satisfies $D(\hat{z}_k)=0$. For example, one could use a root determination method, such as Newton's method, on the determinant.

Replace the draft acceleration curve $\hat{a}$ with a curve generated by a spline using all the points of the previous curve except the adjustment point being replaced by $(\theta_k,\hat{z}_k)$ Form the matrix equation (5) and solve for the unique solutions to that equation for the three scaling factors $c_1,c_2,c_3$ to be respectively applied to the acceleration pulses 230, 232 and 234 of FIG. 2.

The new constraint-satisfied continuous acceleration function is $$a(\theta) = \begin{cases} c_1 \cdot \hat{a}(\theta) & \theta_0 \le \theta < \theta_1, \\ c_2 \cdot \hat{a}(\theta) & \theta_1 \le \theta < \theta_2, \\ c_3 \cdot \hat{a}(\theta) & \theta_2 \le \theta \le \theta_c. \end{cases}$$

The method discussed above assumes that a trial acceleration curve $\hat{a}(\theta)$ meets the following conditions.

1. $\hat{a}(\theta)$ is a piecewise polynomial interpolating function generated by the shape preserving algorithm defined below.

2. $\hat{a}(\theta)$ is a continuous valve acceleration curve defined on the interval $[\theta_o, \theta_c]$.

3. The points $\theta_0$, $\theta_1$, $\theta_2$ and $\theta_c$ satisfy $\theta_0<\theta_1<0<\theta_2<\theta_c$ and are simple roots of $\hat{a}$. That is, these points are where the curve $\hat{a}$ is zero, and $\hat{a}$ is positive in the interval $(\theta_0, \theta_1)$, negative in $(\theta_1, \theta_2)$, and positive in $(\theta_2, \theta_c)$.

Below, a revised algorithm for creating shape preserving quadratic splines is presented. The basic algorithm is due to Schumaker, see Larry L. Schumaker, *On Shape Preserving Quadratic Spline Interpolation*, SIAM J. Numer. Anal., 20(4):854–864, 1983. The algorithm set forth below, like the unrevised version, produces continuously differentiable quadratic splines in such a way that the monotonicity and/or convexity of the input data is preserved. The revised algorithm has the additional property that the splines it produces are more nearly continuous in the y-coordinate values of the knots to be interpolated.

The lines of the algorithm marked with an "*" indicate where the algorithm has changed from the original. Input to the algorithm is a set of n knots (points to interpolate) $\{(t_i,z_i),i=1, \ldots, n, t_i, \text{distinct}\}$. Algorithm 1 (Schumaker—revised)

```
1. Preprocessing.
    For i = 1 step 1 until n − 1,
    l_i = [(t_{i+1} − t_i)^2 + (z_{i+1} − z_i)^2]^{1/2}
    δ_i = (z+ i − z_i)/(t_{i+1} − t_i)
*   ζ = 10^{−16}
2. Slope Calculations.
    For i = 2 step 1 until n − 1,
*   s_i = (l_{i+1}δ_{i+1} + l_iδ_i) / (l_{i+1} + l_i)
3. Left end slope.
    s_i = (3δ_1 − s_2) / 2
4. Right end slope.
    s_n = (3δ_{n−1} − s_{n−1})/2
5. Compute knots and coefficients.
    j = 0.
    For i = 1 step 1 until n − 1,
        if s_i + s_{i+1} = 2δ_i
            j = j + 1,x_j = t_i,A_j = z_i,B_j = s_i,
            C_j = (s_{i+1} − s_i)/2(t_{i+1} + t_i)
        else
            a = (s_i − δ_i),b= (s_{i+1} − δ_i)
*           if ab > 0
*               ξ_i = (b · t_i  1 + a · t_i)/(a + b)
*           elseif a = 0

*               ξ_i = t_{i+1} − ζ · 1/(|b| + 1) · (t_{i+1} − t_i)

*               m = 1;
*               while ξ_i = t_{i+1} − mζ (t_{i+1} − t_i)
*               endwhile
*           else if b = 0

*               ξ_i = t_i + ζ · 1/(|a| + 1) · (t_{i+1} − t_i)

*               m = 1;
*               while ξ_i − t_i = 0
*                   m = 2m
*                   ξ_i = t_i + mζ (t_{i+1} − t_i)
*               endwhile
            else if |a| < |b|
                ξ_i = t_{i+1} + a(t_i  1 − t_i)/(s_{i+1} − s_i)
            else
                ξ_i = t_i + b(t_{i+1} − t_i)/(s_{i+1} − s_i)
            s̄_i = (2δ_i − s_{i+1}) + (s_{i+1} − s_i)(ξ_i − t_i)/(t_{i+1} − t_i)
            η_i = (s̄_i − s_i)/(ξ_i − t_i)
            j = j + 1,x_j = t_i,A_j = z_i,B_j = s_i,C_j = η_i/2
            j = j + 1,x_j = ξ_i,A_j = z_i + si(ξ_i − t_i) + η_i(ξ_i − t_i)^2/2,
                B_j = s̄_i,C_j = (s_{i+1} − s̄_i)/2(t_{i+1} − ξ_i).
```

The following theorem can be mathematically proven and concludes that for every trial acceleration profile formed as a spline produced by Algorithm 1, it is nearly always possible to produce a constraint-satisfied acceleration curve.

Theorem I. Suppose $a\lambda(t)$ is the shape preserving quadratic spline determined by Algorithm 1 for a set of knots $$\{(t_j,z_j), \ldots (t_k,z_k+\lambda), \ldots (t_n,z_n)\},$$

where $t_j$,j=1, . . . n are distinct and increasing. When $\lambda=0$, suppose $a_0(\theta)$ is positive for $\theta\epsilon$ $(\theta_0,\theta_1)$, negative for $\theta\epsilon$ $(\theta_1,\theta_2)$, and positive in $\theta\epsilon$ $(\theta_2,\theta_c)$, where $\theta_0<\theta_1<0<\theta_2<\theta_c$. Suppose further that $$[t_{k-2},t_{k+2}] \subset [0,\theta_2],$$

that $\theta_0=t_1$, and $\theta_c=t_n$, and that for some indices i and j,$t_i=\theta_1$and $t_j=\theta_2$. Let $L_i$1=1, . . . , 5, and $V_i$,1=1, . . . , 4, be defined as set forth above with $\hat{a}=a_\lambda$. Let $\nu_0,\nu_c,l_0,l_c$ and $l_{max}$ be any constants such that $$-\nu_0L_4-V_1(\theta_0\nu_0-l_0+l_{max})\neq 0.$$

Then there exists at least one value of $\lambda$, say $\lambda_0$, such that $$\lim_{\lambda\to\lambda_0,\lambda\neq\lambda_0} \det\begin{pmatrix} L_1 & L_2 & L_3 & -[\theta_c-\theta_0]\nu_0-l_0+l_c \\ V_1 & V_2 & V_3 & \nu_c-\nu_0 \\ L_4 & L_5 & 0 & \theta_0\nu_0-l_0+l_{\max} \\ V_1 & V_4 & 0 & -\nu_0 \end{pmatrix} = 0. \tag{7}$$

Under the hypotheses set forth in the theorem, $L_4$, $V_1$, $\nu_0$, $\theta_0$, $l_0$, and $l_{max}$ do not depend on $\lambda$. Therefore, Theorem I shows that whenever$-\nu_0L_4-V_1(\theta_0\nu_0-l_0+l_{max})\neq 0$, the determinant in equation (7) can always be made arbitrarily close to zero by adjusting a properly located knot of the trial acceleration curve. From a computational point of view, it is nearly always true that only an approximate zero can ever be found to highly nonlinear equations, regardless of the solution technique. Theorem I in effect demonstrates that there is always a "numerical" solution to the constraint satisfaction problem. So long as $-\nu_0L_4-V_1(\theta_0\nu_0-l_0+l_{max})\neq 0$, determinant (7) can always be made arbitrarily close to zero by adjusting $\lambda$, and hence a constraint satisfied curve can always be produced from a trial curve that meets the hypotheses of Theorem I.

Note that while $a(\theta)$ may be continuous across the roots $\theta_1$ and $\theta_2$, the derivative of the constraint satisfied acceleration curve $$\frac{da}{d\theta}(\theta)$$

will not be. The derivative $$\frac{da}{d\theta}(\theta)$$

is typically called the "jerk" of the valve motion. Use of the method of this invention presupposes that a valve acceleration curve with jump discontinuities in the jerk at $\theta_1$ and $\theta_2$ is acceptable.

Testing has been carried out on the method set forth above. So long as the design point $(\theta_k, z_k)$ (i.e., the point that is adjusted to make $D(z_k)=0$) is not too near neighboring points $(\theta_{k-1}, z_{k-1})$ and $(\theta_{k+1}, \theta_{k+1})$, the following observations are generally true for most cases tested:

The acceleration value $z_k$ (knot 244 of FIG. 2) need move only a tiny amount (see arrow 244*a* of FIG. 2).

Provided $I(0)-I_{max}$ is not too large, scaling constants typically differ from 1 by only a few percent. Therefore, the change to the trial curve is usually difficult to perceive. Hence, the method yields a constraint satisfied curve that looks quite similar to the trial curve 202.

Figure 5:
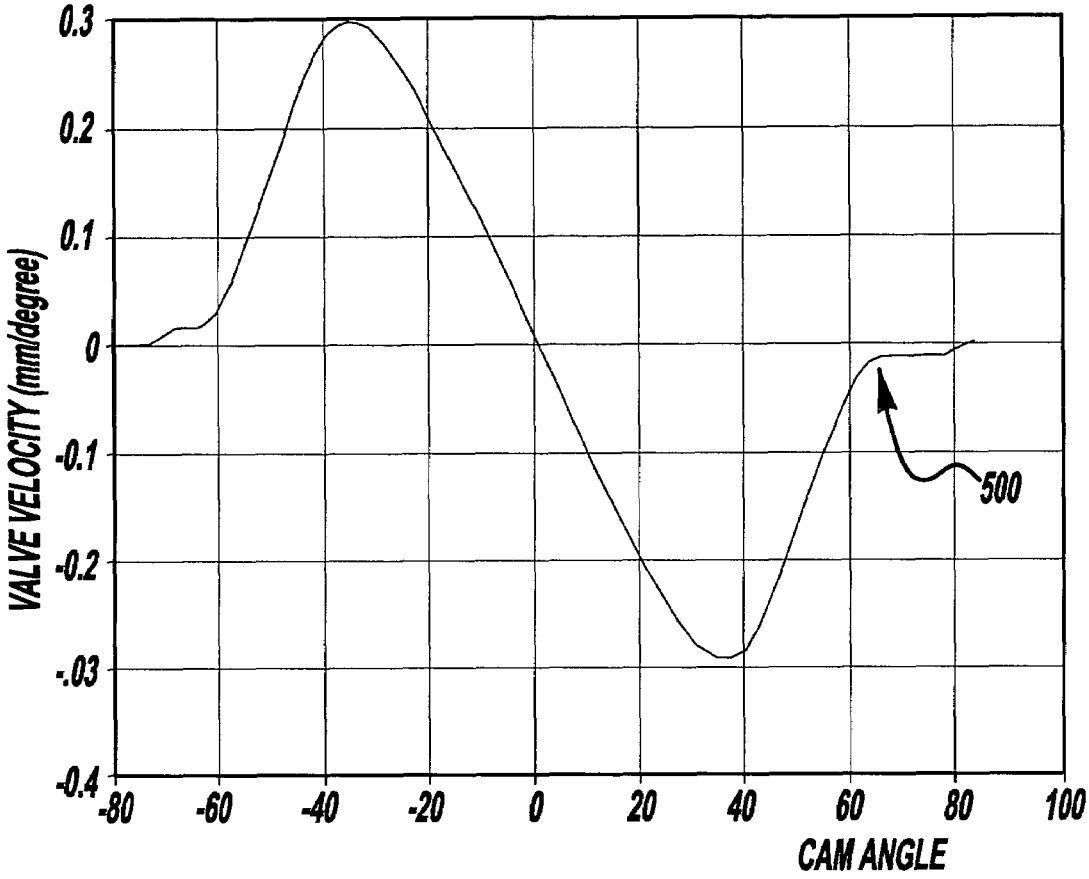
FIG. 5 sets forth a graph of valve velocity versus cam angle resulting from an acceleration curve which has been adjusted to meet valve motion constraints.
Figure 6:
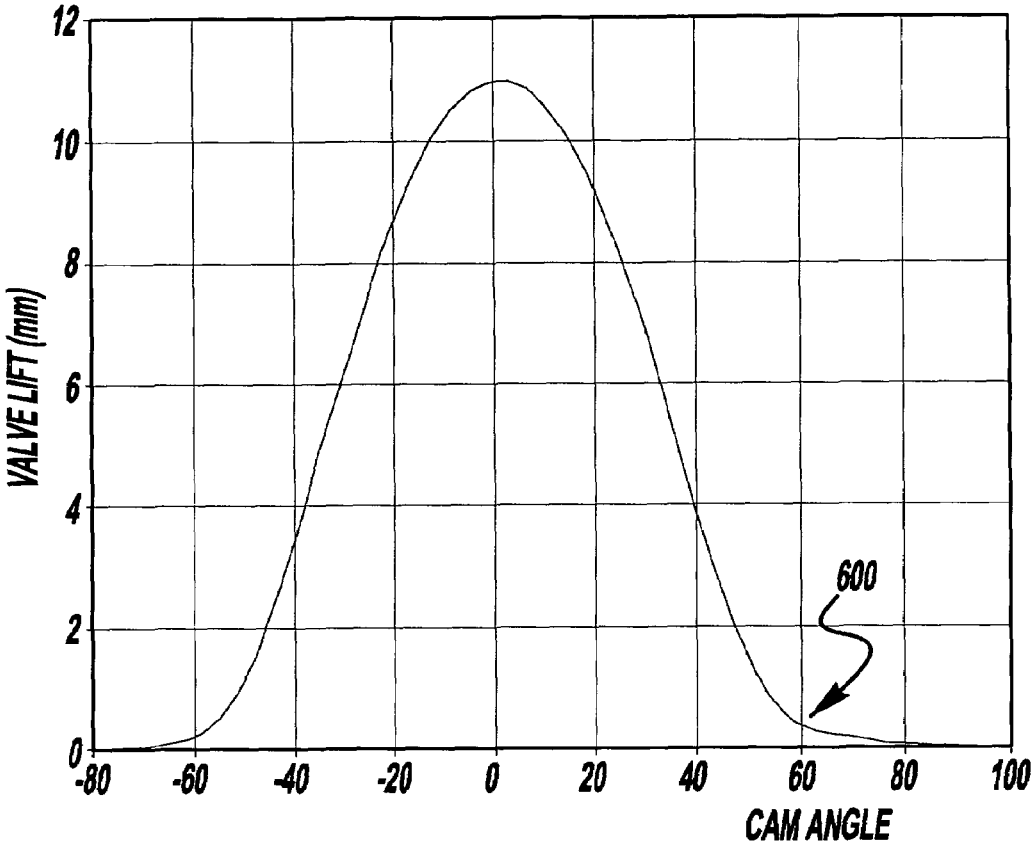
FIG. 6 sets forth a graph of valve lift versus cam angle resulting from an acceleration curve which has been adjusted to meet valve motion constraints.

When the initial draft acceleration profile has been modified in accordance with the above method, the constraints will be satisfied as seen from FIGS. 5 and 6. FIG. 5 shows at area 500 that the valve velocity resulting from the adjusted acceleration profile will match that generated by the end ramp of FIG. 2. Similarly, FIG. 6 shows that at area 600 the valve lift will match that required by the end ramp of FIG. 2.

To assure a solution to the nonlinear equation $D(z_k)=0$ exists and thus assure success in meeting the valve motion constraints, the selection of an adjustment point should be made in accordance with the following.

First, it is recommended that the trial or draft curve contain five or more distinct knots, e.g., 240, 242, 244, 246 and 214, of FIG. 2 which have distinct cam angle coordinates within interval $[0, \theta_2]$.

Second, the adjustment point (knot 244) should be selected such that the two knots immediately left (240, 242) and the two knots immediately to the right (246, 214) of the adjustment point 244 have cam angle coordinates $\theta$ that are equal to or between zero cam angle and the third root $\theta_2$ of the acceleration curve.

These two recommendations insure that only the area of the design curve 202 that is between cam angle zero and cam angle $\theta_2$ is affected by a change to the adjustment point $z_k$.

In conjunction with selecting the adjustment point in accordance with the above recommendations, the curve fitting routine or spline used to generate the adjusted acceleration profile is optimized as shown above by insuring that the quadratic spline will only alter the initial draft acceleration curve at segments between two knots on either side of the adjustment point. In other words, for example, if the adjustment point 244 of FIG. 2 is moved positively or negatively as shown by arrow 244*a*, the resultant adjusted acceleration profile generated by applying the spline to the new data set with the altered point 244 will change the original acceleration profile curve only in segments 241, 243, 245, and 247—i.e., those segments of the acceleration profile between the two points on either side of the adjustment point.

The invention has been described in connection with an exemplary embodiment and the scope and spirit of the invention are to be determined from an appropriate interpretation of the appended claims.

What is claimed is:

1. A method for generating an acceleration profile for a valve operating cam of an internal combustion engine, the profile satisfying a plurality of constraints, the method comprising:

generating a valve acceleration versus cam angle draft curve by specifying a plurality of points of desired valve acceleration versus cam angle and using a curve fitting routine to form the draft acceleration curve interconnecting the plurality of points;

developing a set of equations, one for each of the plurality of constraints in terms of parameters of the draft acceleration curve and a plurality of scaling factors, one for each section of the draft curve between roots thereof, and forming a determinant for the set of equations;

selecting at least one point on the draft curve as an adjustment point;

varying the adjustment point to an adjustment acceleration value that forces the determinant to substantially zero;

using the curve fitting routine to generate an adjusted acceleration curve including the adjustment acceleration value;

solving the set of equations for values of the scaling factors as a function of parameters of the adjusted acceleration curve; and multiplying values in sections of the draft acceleration curve between roots thereof by resultant values of a corresponding scaling factor to generate and store a constraint satisfied acceleration profile.

2. The method of claim 1 wherein the plurality of constraints comprise:

valve closing lift;

valve closing velocity;

valve maximum lift; and valve velocity at zero cam angle.

3. The method of claim 1 wherein the adjustment acceleration value is non-zero.

4. The method of claim 3 wherein the at least one adjustment point is selected as the second point past zero degree cam angle in a positive cam angle direction.

5. The method of claim 1 wherein the adjustment acceleration value is derived using Newton's method of root calculation on the determinant.

6. The method of claim 1 wherein a change in the acceleration of the at least one adjustment point to reach the adjusted acceleration value is determined using a zero-finding routine to make the determinant approach zero to within a predetermined tolerance value.

7. The method of claim 1 wherein the specified plurality of points of desired valve acceleration includes at least five points having distinct cam angles equal to or between zero cam angle and a next root in a positive cam angle direction.

8. The method of claim 7 wherein the at least one adjustment point is selected as a middle point of the five points.

9. The method of claim 1 wherein the curve fitting routine is arranged such that only a portion of the draft acceleration curve is altered when the at least one adjustment point is varied.

10. The method of claim 9 wherein the curve fitting routine is arranged such that the draft acceleration curve is altered only at segments between two curve points on either side of the at least one adjustment point when the at least one adjustment point is varied.

11. The method of claim 1 wherein the curve fitting routine is based on a quadratic function.

12. The method of claim 9 wherein the curve fitting routine is based on a quadratic function.

13. The method of claim 10 wherein the curve fitting routine is based on a quadratic function.

14. The method of claim 8 wherein the curve fitting routine is arranged such that the draft acceleration curve is altered only at segments between two curve points on either side of the at least one adjustment point when the at least one adjustment point is varied.

15. A method for generating an acceleration profile for a valve operating cam of an internal combustion engine wherein the acceleration profile satisfies four valve motion constraints on valve closing velocity, valve closing lift, valve maximum lift and valve velocity at zero cam angle, the method comprising:

generating a valve acceleration versus cam angle draft curve by specifying a plurality of points of desired valve acceleration at a like plurality of cam angles, thereby defining a positive opening acceleration pulse, followed by a negative valve spring acceleration pulse, followed by a positive closing acceleration pulse;

using a curve fitting routine to form the draft acceleration curve interconnecting the plurality of points;

developing a set of four equations, one for each of the four constraints in terms of parameters of the draft acceleration curve and three scaling factors, one for each of the acceleration pulses;

forming a determinant for the set of four equations;

selecting a point on the draft curve as an adjustment point;

varying the adjustment point to an adjustment acceleration value that forces the determinant to substantially zero;

using the curve fitting routine to generate an adjusted acceleration curve including the adjustment acceleration value;

solving the four equations for values of the three scaling factors as a function of the parameters of the adjusted acceleration curve;

scaling the positive opening, negative valve spring and positive closing acceleration pulses of the adjusted acceleration curve with the first, second and third scaling factors, respectively, and storing the results.

16. The method of claim 15 wherein the specified plurality of points of desired valve acceleration includes five points with cam angle coordinates equal to or between zero cam angle and the end of the negative valve spring acceleration pulse, and wherein the adjustment point is selected as the middle one of the five points.

17. The method of claim 15 wherein the curve fitting routine is based on a quadratic function.

18. The method of claim 16 wherein the curve fitting routine is operative to generate the adjusted acceleration curve differing from the draft acceleration curve only in sections of the adjusted acceleration curve extending between adjacent pairs of the five points.

19. The method of claim 17 wherein the curve fitting routine is operative to generate the adjusted acceleration curve differing from the draft acceleration curve only in sections of the adjusted acceleration curve extending between adjacent pairs of the five points.

20. The method of claim 15 wherein the curve fitting routine is arranged such that only a portion of the draft acceleration curve is altered when the adjustment point is varied.

* * * * *